US006060675A

United States Patent [19]

Borg et al.

[11] Patent Number: 6,060,675

[45] Date of Patent: May 9, 2000

[54] STERILE SHIELD FOR SURGICAL APPARATUS CONTROLS

[76] Inventors: Lynn A. Borg; Gary F. Borg, both of 449 Countrywood La., Encinitas, Calif. 92024

[21] Appl. No.: 09/296,182

[22] Filed: Apr. 26, 1999

[51] Int. Cl.[7] ..... H01H 9/04

[52] U.S. Cl. ..... 200/302.1; 200/302.1

[58] Field of Search ..... 200/302.1, 302.3; 206/438, 439, 363, 572

[56] References Cited

U.S. PATENT DOCUMENTS 3,316,379 4/1967 Clarke et al. ..... 200/168

*Primary Examiner*—Michael L. Gelner

*Assistant Examiner*—Nhung Nguyen

*Attorney, Agent, or Firm*—Henri J.A. Charmasson; John D. Buchaca

[57] ABSTRACT

A disposable sterile cover, for the control lever of an instrument, comes packaged into a disposable sterile envelope. A central raised area of the cover fits loosely over the control lever while the remaining peripheral flat area of the cover remains in contact with the surrounding control panel portion, allowing the control lever to be manipulated during a surgical procedure by the surgeon without compromising the sterility of her hands.

12 Claims, 1 Drawing Sheet

STERILE SHIELD FOR SURGICAL APPARATUS CONTROLS

FIELD OF THE INVENTION

This invention relates to shrouds and protective covers and more specifically, to protective covers used in sterile environments such as a surgical operating room.

BACKGROUND OF THE INVENTION

Complete sterility of a surgeon's hands is an absolute requirement during all surgical operations. The surgeon must go through a long scrubbing sequence, wear sterile gloves and employ scalpels and other instruments that have been thoroughly decontaminated. Nowadays, a surgeon and his assistants do not use only hand tools that can be easily sterilized. They must also manipulate complex electronic and optical instruments whose sterility cannot be easily assured. Effective disinfecting agents such as chlorine or povidone iodine are far too corrosive to be applied to the control panels, switches, handles, knobs or pushbuttons of a surgical laser, microscope, vital sign monitor or other such instrument. If anyone of those control instruments must be manipulated by the surgeon during the procedure, it is common practice to cover such a control implement with a layer of sterile gauze and secure it with a sterile rubber band. However, there is certain procedures such as eye surgeries, where the presence of lint or any kind of fibre on the surgeon's fingers may seriously compromise the operation.

The instant invention results from an attempt to deal with the aforesaid problems and shortcomings.

SUMMARY OF THE INVENTION

The principal and secondary objects of this invention are to provide a convenient means to safeguard the sterility of a surgical environment while allowing the medical practitioners to handle and manipulate a variety of operating room instruments that do not lend themselves to thorough decontamination.

These and other valuable objects are achieved by the use of a cover shaped and dimensioned to conveniently fit over a switch handle, knob, or similar manipulable control implement. The cover is made from a non-woven, pliable, and sterile material, and comes in a sterile envelope. The envelope has a breakable seal which allows access to, and removal of the cover.

DESCRIPTION OF THE PREFERRED EMBODIMENT OF THE INVENTION

Figure 1:
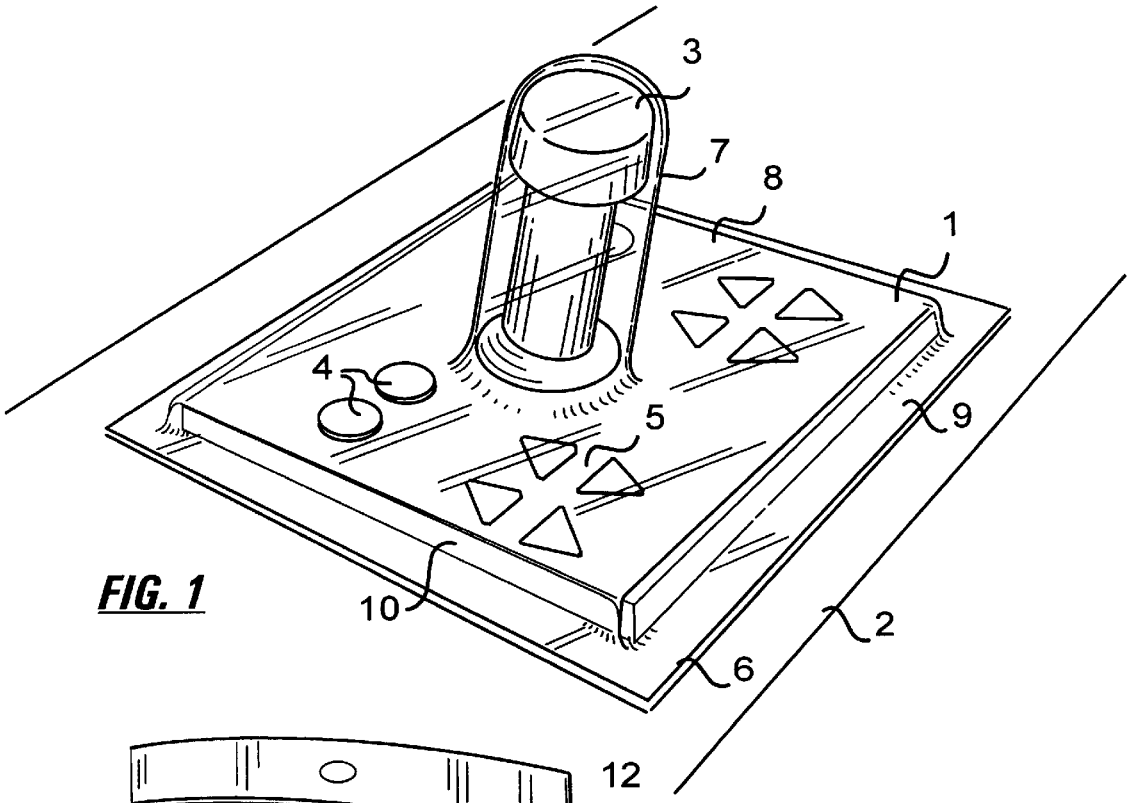
FIG. 1 perspective view of a cover according to the invention mounted over the control handle and control panel of a surgical operating room instrument.
Figure 2:
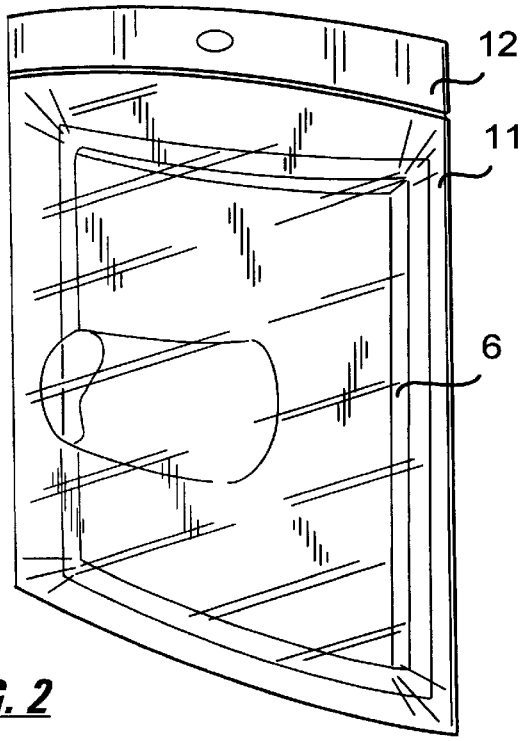
FIG. 2 is a perspective view of a cover in its sterile package.

Referring now to the drawing, there is shown in FIG. 1, the control panel 1 of a surgical operating room instrument 2. More specifically, the instrument 2 is annexed to a surgical laser or surgical microscope and provides aiming control for the device through the manipulation of a multi-directional lever or handle 3 commonly known as a joy-stick. The lever protrudes from the center of the control panel 2 and is surrounded by a variety of other control implements such as pushbuttons 4 and touch pads 5. An unattached, protective cover 6 has a central raised area 7 which is shaped and dimensioned to loosely fit over the joy-stick 3 while the remaining flat, peripheral area of the cover 8 remains in contact with the front panel 1. The cover 6 is transparent so that the various control implements 4, 5 can be clearly seen and accessed through it. The loose fitting of the cover over the joy-stick allows for manipulation of that implement in various directions with minimal movement of the peripheral non-raised area 8 of the cover. In this particular embodiment of the cover, a peripheral, marginal area 9 has been shaped to conform loosely to the raised edge 10 of the control panel. The cover is made by hot-stamping a sheet 150 micron (6 mil) of vinyl. The cover is sterilized and packaged in a sterile transparent envelope 11 of the type illustrated in FIG. 2. The envelope 11 is provided with a tearable portion or breakable portion 12 which, once removed, provides access to the cover 6. Several covers of the general type and shape illustrated in the drawing can thus be conveniently used over all the switches, handles, pushbuttons, knobs and other control implements which may come into contact with the surgeon's hands during an operation. After the operation, the covers can be conveniently disposed of in view of their low cost and ease of installation.

While the preferred embodiment of the invention has been described, modifications can be made and other embodiments may be devised without departing from the spirit of the invention and the scope of the appended claims.

What is claimed is:

1. A protective cover for shielding at least one manipulable control implement protruding from a control panel portion of an apparatus used in a sterile environment such as an operating room, said cover comprising:

a disposable, unsecured sheet of sterile, transparent, pliable, non-woven, synthetic material having a central raised area; and a substantially flat peripheral, non-raised area surrounding said raised area;

wherein said raised area is shaped and dimensioned to loosely fit over said control implement while said non-raised area lies in loose-moving contact with said control panel portion;

whereby manipulation of the control implement does not compromise the sterility of an operator's hands.

2. A protective cover for shedding at least one manipulable control implement protruding from a control panel portion of an apparatus in a sterile environment such as an operating room, said cover comprising:

a sheet of strile, pliable, non-woven, synthetic material having a central raised area; and a substantially flat peripheral non-raised area surrounding said raised area;

wherein said raised area is shaped and dimensioned to loosely fit over said control implement while said non-raised area lies in contact with said control panel portion;

whereby manipulation of the control implement does not compromise the sterility of an operator's hands; and which further comprises a sealed, sterile envelope sized and shaped to hold said sheet, and having a breakable or peelable portion whose removal provides access to said sheet.

3. The cover of claim 2, wherein said envelope is made of soft, pliable, and non-woven synthetic material.

4. The combination of an apparatus, used in a sterile environment such as a surgical operating room, said apparatus having at least one control implement protruding from a control panel portion to be manipulated by an operator, with a protective cover which comprises:

a sheet of disposable sterile, transparent, pliable and non-woven synthetic material having in a central raised area, and a peripheral non-raised area;

wherein said raised area is shaped and dimensioned to loosely fit over said control implement while said non-raised area remains in loosely moving contact with said control panel portion;

whereby said control implement can be actioned without compromising the sterility of the operator's hands.

5. The combination of an apparatus, used in a sterile environment such as a surgical operating room, said apparatus having at least on control implement protruding from a control panel to be manipulated by an operator, with a protective cover which comprises:

a sheet of sterile, pliable and non-woven synthetic material having in a central raised area, and a peripheral non-raised area;

wherein said raised area is shaped and dimensioned to loosely fit over said control implement while said non-raised area remains in contact with said control panel portion;

whereby said implement can be actioned without compromising the sterility of the operator's hands; and which further comprises a sealed, sterile envelope sized and shaped to hold said sheet, and having a breakable or peelable portion whose removal provides access to said sheet.

6. The combination of claim 5, wherein said envelope is made of soft, pliable, and non-woven synthetic material.

7. The combination of claim 4, wherein said apparatus comprises a device for controlling the aim of a surgical laser instrument.

8. The combination of claim 7, wherein said control implement comprises a lever.

9. The combination of claim 8, wherein said lever is manipulable in a plurality of directions.

10. The combination of claim 4, wherein said control panel portion comprises at least one more control implement.

11. A method for safeguarding the sterility of an operator's hands in a surgical environment in connection with the manipulation of an instrument control implement comprising:

covering said control implement with a disposable sterile cover having a central raised area shaped and dimensioned to loosely fit over said control instrument, and a substantially flat peripheral area; and which further comprises packaging said cover in a sealed, sterile envelope.

12. The method of claim 11 which further comprises providing said envelope with a breakable or peelable portion whose removal provides access to said sheet.

* * * * *